United States Patent [19]

Douglas et al.

[11] Patent Number: 4,967,656

[45] Date of Patent: Nov. 6, 1990

[54] ECCENTRIC CYLINDER FOR SHEET-FED ROTARY PRINTING PRESSES

[75] Inventors: David D. Douglas, Garland; James A. Elliott, Euless, both of Tex.

[73] Assignee: Printing Research, Inc., Dallas, Tex.

[21] Appl. No.: 369,309

[22] Filed: Jun. 21, 1989

[51] Int. Cl.[5] ..... B41F 9/00

[52] U.S. Cl. ..... 101/142; 101/409; 271/270; 271/277; 271/204

[58] Field of Search ..... 101/142, 137, 140, 147, 101/177, 215, 217, 218, 251, 409; 271/204, 206, 270, 277

[56] References Cited

U.S. PATENT DOCUMENTS

| | | | |
|---|---|---|---|
| 2,220,046 | 10/1940 | Lang | 271/270 |
| 2,387,750 | 10/1945 | Davidson | 101/218 |
| 2,563,646 | 8/1951 | Gruver | 101/142 |
| 2,892,630 | 6/1959 | Schunemann | 271/270 |
| 3,918,707 | 11/1975 | Villemer et al. | 271/277 |
| 4,204,471 | 4/1980 | Becker | 271/277 |
| 4,290,595 | 9/1981 | Thunker | 271/277 |
| 4,358,100 | 11/1982 | Muller | 101/409 |
| 4,722,273 | 2/1988 | Jahn | 101/142 |

*Primary Examiner*—Eugene H. Eickholt

*Attorney, Agent, or Firm*—Kelly, Bauerfeld & Lowry

[57] ABSTRACT

A transfer or delivery cylinder for a sheet-fed rotary printing press having an endless chain conveyor carrying gripper bars and grippers and driven by a sprocket wheel concentrically mounted on a drive shaft for pulling freshly printed sheets from the impression cylinder onto the transfer or delivery cylinder for movement to a further processing station within the press, wherein the transfer or delivery cylinder is a right circular cylinder eccentrically mounted to the drive shaft so that upon initial engagement of the freshly printed sheet by the grippers, the leading edge of the cylinder is spaced below the sheet which is thereafter pulled smoothly and uniformly into contact tangentially with the sheet support surface of the transfer or delivery cylinder.

12 Claims, 3 Drawing Sheets

-24-
16
-30-
31
15
17
D
50
10
x
52
56
48
40
54
60
16
58
44
42
-28-
38
15
36
34

-24-
17
38
36
46
50
10
31
16
-30-
15
60
58
52
D
44
54
40
-28-
48
x
34

-24-
31
16
44
15
50
38
36
-30-
17
60
46
58
-54-
10
52
48
16
-28-
x
D
34

-24-
16
48
10
31
-30-
52
60
16
D
44
56
17
58
15
-28-
38
46
36
x
34

ECCENTRIC CYLINDER FOR SHEET-FED ROTARY PRINTING PRESSES

BACKGROUND OF THE INVENTION

This invention relates to high speed, sheet-fed printing presses, and more particularly, to a new and improved transfer or delivery cylinder and method of mounting the cylinder in such presses to reduce marking and marring of the freshly printed surface.

In high speed sheet-fed rotary printing presses, freshly printed sheets must be transferred from the impression cylinder to additional processing stations within the press, typically to further impression cylinders for additional printing, or to the delivery station of the press. During such transfer, the wet ink side of the printed sheet must be supported in such a manner that the freshly printed sheet is not marked or marred or the wet ink smeared. One system for insuring that the freshly printed sheet is not marked or marred during transfer is the transfer or delivery cylinder and system marketed by Printing Research, Inc. of Dallas, Texas under the United States registered trademark, "Super Blue". That system, which is made and sold under license, is made in accordance with and operates as described in U. S. Pat. No. 4,402,267, issued Sept. 6, 1983 to Howard W. DeMoore, and comprises, broadly, a right circular transfer or delivery cylinder or wheel mounted on a central drive shaft for rotation thereby, and which is provided with a PTFE (Teflon) coated outer cylindrical sheet support surface over which is loosely mounted a fabric cover referred to in the trade as a "net". It is believed that the loosely mounted net attaches and clings to the printed sheet as the sheet is supported by the cylinder whereby any relative motion between the sheet and cylinder takes place between the surface of the net and the PTFE coated surface of the cylinder so that marking and marring of the printed sheet does not occur.

Typically, high speed sheet fed presses are used to print a wide variety of sheet thickness, generally from very thin "onion skin" type paper having minimum thickness on the order of 0.002 inches (0.05mm) to relatively thick cardboard materials having maximum thickness on the order of 0.034 inches (0.86mm). In order to accommodate the wide variety of sheet thickness, the clearance between the nip of the impression cylinder and the transfer or delivery cylinder must be properly controlled to ensure that each thickness sheet will smoothly transfer from the impression cylinder to the transfer or delivery cylinder without marking or marring.

While the "Super Blue" system marketed by Printing Research, Inc., has met with substantial commercial success, it has been found that some sheet marking or marring of the wet inked surface may occur on the leading or gripper end portion of the printed sheet during initial transfer of the sheet from the impression cylinder. This is believed to be caused by the relatively sharp bend which the sheet must undergo as the sheet grippers, which are associated with the transfer or delivery cylinder, grip the sheet leaving the impression cylinder and initially pull the sheet into contact with the net covered cylindrical support surface of the transfer or delivery cylinder, this bending of the sheet causing the sheet to initially rub against the net until the net has attached to the sheet rearwardly of the sheet leading or gripper end.

In an effort to solve the problem of marking on the gripper end portion, attempts have been made to reduce sheet bend by making the overall diameter of the cylinder smaller so as to increase the clearance between the nip of the impression cylinder and that of the transfer cylinder. While this solution helps reduce marking on the gripper end portion, the increased clearance has been found to induce sheet "flutter" and "slap" at the tail end portion of the sheet with the result that marking or marring of the sheet occurs in the area of the sheet tail end.

"Flutter", which is a vibrational fluctuation of the sheet, typically has been found to occur when printing sheets having thickness in the approximate range of 0.010 inches (0.25mm) down to 0.002 inches (0.05mm), and is believed to be caused by the release of sheet tension as the tail end of a sheet leaves the nip of the impression cylinder and transfer or delivery cylinder. This release of tension is believed to induce a vibrational fluctuation or flutter of the sheet tail end portion causing marking or marring as the sheet flaps against the surface of the transfer or delivery cylinder until the flutter is damped and the sheet attaches to the net.

"Slap", which is a spring back effect caused by release of the tail end of the sheet bent around the impression cylinder as it leaves the nip of the impression cylinder and .the transfer or delivery cylinder, has typically been found to occur when printing sheets having thicknesses in the approximate range of 0.010 inches (0.25mm) up to 0.034 inches (0.86mm). This spring back of the sheet to its original unbent condition upon leaving the nip causes the tail end portion to slap against the surface of the transfer or delivery cylinder causing marking and marring.

Another suggestion that has been made for solving the problem of marking in the gripper end portion of the sheet is that set forth in U.S. Pat. No. 4,690,054 issued Sept. 1, 1987 and assigned to M.A.N. Roland Druckmaschinen Aktiengesellschaft of the Federal Republic of Germany. That prior art patent describes a transfer or delivery cylinder (referred to in that patent as a "drum") wherein the fabric covered drum outer contour is constructed in such a manner that the front or leading edge portion is in the form of a smooth and continuously increasing spiral which merges into a fixed drum radius so that the fabric covered drum surface is contacted by the freshly printed surface of the sheet on the spiral surface first substantially flatly behind the front edge of the drum and then in any subsequent angle of rotation of the drum without the sheet tangent ever being bent or creased.

While the solution suggested in the aforementioned M.A.N. Roland patent may help solve the problem of sheet marking or marring in the area of the sheet leading or gripper end, it does not address the problem of sheet flutter or slap causing marking in the area of the sheet center or trailing edge. Moreover, the construction of a cylinder having the outer contour suggested by this patent is quite difficult and expensive to manufacture. It is also believed that due to the inherent nature of the increasing radius of the spiral portion of the cylinder, the sheet may actually be bent more on initial contact than would be the case with a right circular cylindrical surface, thereby resulting in an increased likelihood of sheet marking or marring rearwardly of the leading or gripper end. That is, the increasing radius spiral just moves the point of sheet marking rearwardly toward the trailing end.

Thus, there exists a need for a transfer or delivery cylinder system which will insure that the freshly printed sheet will be transferred from the impression cylinder without excessive bending of the sheet on initial contact with the support surface of the cylinder, yet will not cause the center or trailing end of the sheet to flutter or slap against the cylinder, thereby to prevent marking on either the leading, center or trailing edges. Further, there exists a need for such a transfer or delivery cylinder which is relatively simple in design, easily made, and economical to manufacture. As will become apparent hereinafter, the present invention solves this need in a novel and unobvious manner.

SUMMARY OF THE INVENTION

The present invention provides a new and improved transfer or delivery cylinder which is mounted within a rotary printing press in such a manner that the freshly printed sheet pulled from the impression cylinder by the grippers will always initially engage the support surface of the cylinder tangentially so that marking and marring of the printed sheet in the area of the leading end is substantially eliminated, and which substantially eliminates any flutter or slapping of the center or trailing or tail end portion of the sheet and insures that the tail portion will smoothly and evenly attach to the net covered surface of the cylinder without marking or marring.

The cylinder of the invention, which is formed as a right circular cylinder, is eccentrically mounted to its drive shaft which also drives conveyor chains to which gripper bars carrying sheet grippers are attached, such that the leading or gripper edge of the cylinder will lie below the gripper bar as the grippers initially pull the freshly printed sheet from the impression cylinder onto the transfer or delivery cylinder so as to effectively increase the clearance between the impression cylinder and the transfer or delivery cylinder. As the drive shaft continues to rotate the eccentrically mounted transfer or delivery cylinder, the effective diameter of the cylinder increases and rises to smoothly and uniformly tangentially engage the sheet rearwardly of its gripper end. Continued rotation of the eccentrically mounted cylinder causes the trailing or tail end portion to further rise and effectively reduce the clearance between the impression cylinder and the transfer or delivery cylinder so that the tail portion of the sheet smoothly and uniformly engages the net, thereby reducing the tendency of the center or tail portion of the sheet to flutter or slap against the net covered surface.

In the preferred form of the present invention, the cylinder is mounted to the drive shaft such that the axis of gyration of the cylinder support surface is laterally off-set along a diametrical plane extending through the axis of rotation of the drive shaft toward the leading or gripper edge of the transfer or delivery cylinder. Preferably, the amount of off-set is between approximately 1/16 inch (1.52mm) and approximately ½inch (12.7mm) so that the sheet will tangentially engage the support surface of the cylinder after approximately forty five degrees of rotation from the point of initial sheet engagement by the grippers. With this arrangement, the transfer of a freshly printed sheet from the impression cylinder to the transfer or delivery cylinder will always take place tangentially, thereby eliminating excessive bending of the sheet which could cause marking and marring of the gripper end portion of the printed surface, and as the transfer or delivery cylinder continues to rotate, the clearance between the impression cylinder and the transfer or delivery cylinder effectively reduces sufficiently to prevent sheet flutter and slap which could cause marking and marring of the center or tail end portion of the sheet.

Many other features and advantages of the present invention will become more apparent from the following detailed description taken in conjunction with the accompanying drawings which disclose, by way of example, the principles of the invention.

DESCRIPTION OF THE PREFERRED EMBODIMENT

Figure 1:
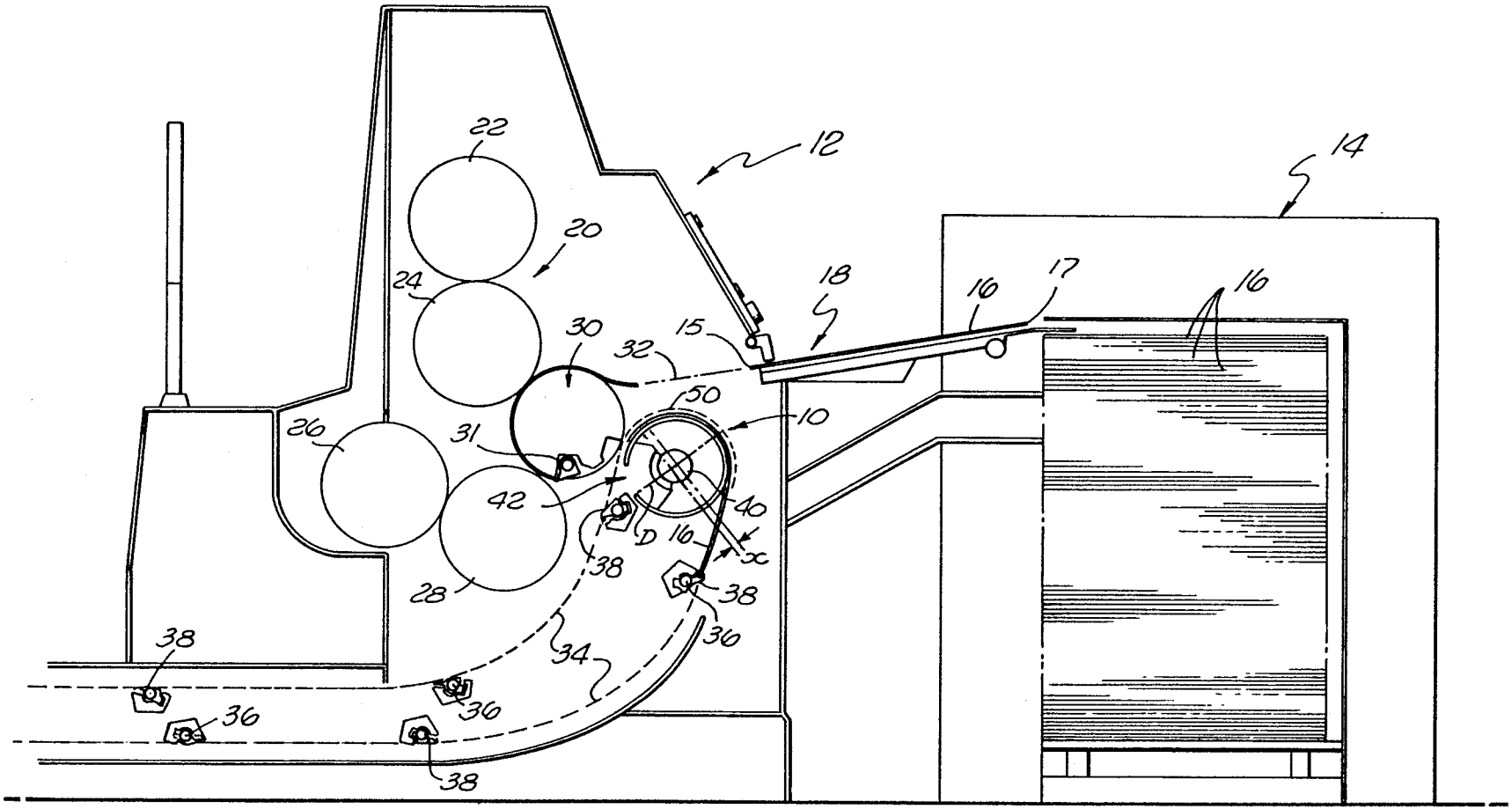
FIG. 1 is a schematic side elevational view of a multicolor sheet-fed off-set rotary printing press with a five cylinder, common printing unit and a chain conveyor carrying sheet grippers trained around a sheet transfer or delivery cylinder made and mounted in accordance with the present invention.

As shown in the exemplary drawings, the present invention is embodied in a new and improved transfer or delivery cylinder 10 and method of mounting the cylinder in a high speed, sheet-fed rotary offset printing press 12 of conventional design. In this instance as shown in FIG. 1, the press 12, which is only partially illustrated for purposes of simplification and herein is schematically shown as a multi-color press of the type made by M.A.N. Roland, includes a feeder station 14 wherein a supply of individual sheets 16 to be printed are stacked, and a conveyor system 18 by which individual sheets are withdrawn from the feeder and moved one at a time sequentially into an initial station 20 within the press for printing. As illustrated herein, the initial printing station 20 comprises two pairs of plate and blanket cylinders 22 and 24, and 26 and 28, respectively, and an impression cylinder 30, the impression cylinder having a set of sheet grippers 31 which hold the leading or gripper edge of the sheet during rotation of the impression cylinder. As a sheet 16 is moved into the press 12 along the paper path designated by the arrows 32, the sheet travels around the impression cylinder 30 where it is imprinted with two-color print, and then is conveyed to a second printing station (not shown) similar in to the initial station 20, or to a delivery station (also not shown) wherein the printed sheets are stacked for removal from the press.

To effect transfer of the printed sheet 16 from the impression cylinder 30, the press 12 conventionally is provided with a pair of parallel endless conveyor chains 34, only one of which is shown, and which are laterally spaced on either side of the press. The conveyor chains 34 carry a series of gripper bars 36 of well known construction and operation, longitudinally spaced along and extending laterally between the chains, and to which are attached a plurality of sheet grippers 38 spaced along the gripper bars. The gripper bars 36 and attached grippers 38 ar located at intervals along the chains 34 to grip the leading end 15 of each printed sheet 16 after it leaves the nip of the impression cylinder 30 and the transfer or delivery cylinder 10, and operate to pull the printed sheet from the impression cylinder and hold the gripper end of the sheet as the sheet is supported by the transfer or delivery cylinder of the present invention and transferred to the next processing station within the press 12.

As will be described in more detail hereinafter, the cylinder 10 of the present invention, which may be either a transfer or a delivery cylinder depending upon where in the press 12 the cylinder is used and whether the sheet is conveyed to a further printing station (transfer cylinder) or to the delivery station (delivery cylinder), is supported for rotation on a drive shaft 40 which extends laterally across the press adjacent the impression cylinder 30. As used hereinafter, the term "transfer cylinder" will be used to refer to the cylinder 10 of the present invention, it being understood that the present invention is not limited to only "transfer" cylinders, but equally applies to "delivery" cylinders since the only difference is to where the sheet 16 is being transferred by the cylinder, a difference not important to the principles of the present invention.

The transfer cylinder 10 has a lateral length which approximates that of the impression cylinder 30, and is formed to have a longitudinally extending opening 42 in its outer support surface for receiving the gripper bars 36 and associated grippers 38, the edges of the opening defining a cylinder leading or gripper edge 44 and a cylinder trailing or tail edge 46, as viewed in the direction of cylinder rotation indicated by the arrow 48. It will be understood that the drawings herein are schematic and exaggerated to more clearly show the relative relationships between the pertinent parts, the details of conventional press components being well known to those familiar with the art to which the present invention pertains.

Preferably, the transfer cylinder 10 is provided with an antifriction coating on the outer cylindrical sheet supporting surface, and is covered with a fabric material, referred to in the trade as a "net" (not shown), as is described in more detail in the DeMoore U.S. Pat. No. 4,402,267. The net, which is relatively loosely mounted to the sheet supporting surface of the cylinder 10, clings to the printed side of the sheet and permits any relative motion between the sheet and the cylinder surface to take place between the net and cylinder, thereby preventing the sheet from rubbing on the cylinder support surface in a manner which may cause marking or marring of the freshly printed sheet.

Coaxially secured at each of the lateral ends of the drive shaft 40 adjacent the laterally outer ends of the transfer cylinder 10 is a conventional sprocket type drive wheel of circular cross-section, herein the outer periphery 50 of which is schematically illustrated in broken line, and which operates to engage and drive the associated conveyor chain 34 during transfer of the printed sheet 16 from the impression cylinder 30 to the next station within the press 12. The spacing of the gripper bars 36 along the chains 34 relative to the opening 42 in the transfer cylinder 10 and the diameter of the sprocket wheel 50 are chosen such that with each complete revolution of the transfer cylinder, one gripper bar will align with the opening, and the gripper bar and its associated grippers 38 will become at least partially recessed into the opening as the drive shaft 40 rotates the sprocket wheels and the transfer cylinder disposed therebetween. In this manner, the gripper bars 36 and associated grippers 38 can pass between the very small space or nip between the transfer cylinder 10 and the surface of the impression cylinder 30.

In accordance with the present invention, the transfer cylinder 10 is designed for mounting to the drive shaft 40 in such a manner that as the grippers 38 engage and pull the freshly printed sheet 16 from the impression cylinder 30, the gripper edge of the cylinder will be below the leading end 15 of the sheet so that the sheet will always initially engage the support surface of the transfer cylinder tangentially, thereby preventing undue bending of the sheet and eliminating any marking or marring of the surface caused thereby, yet will prevent sheet marking and marring caused by flutter and slap at the center or tail end 17 by increasing the effective diameter of the cylinder to reduce the clearance between the impression cylinder and the transfer cylinder. Moreover, the transfer cylinder 10 of the present invention is simple in design, easily made, and relatively economical to manufacture, yet is highly reliable and effective in use.

Toward the foregoing ends, the transfer cylinder 10 is eccentrically mounted on the drive shaft 40 such that the gripper edge 44 of the transfer cylinder will pass under the leading end 15 of the sheet 16 as the sheet is initially pulled from the impression cylinder 30 by the grippers 38. As the sheet continues to be pulled around the transfer cylinder 10, due to the eccentric mounting, the transfer cylinder will rotate into contact with the sheet 16 tangentially as its effective diameter slowly increases and with further rotation toward engagement by the tail end 17, will increase in effective diameter to a maximum whereby the clearance between the impression cylinder 30 and the transfer cylinder will be decreased sufficiently to prevent flutter and slap at the center or tail end of the sheet. The eccentric mounting of the transfer cylinder 10 on the drive shaft 40 insures that the sheet 16 will always initially engage the support surface of the transfer cylinder tangentially whereby excessive bending of the sheet in the region of the gripper edge 44 of the cylinder cannot take place, yet will insure that the clearance between the impression cylinder and the transfer cylinder is small enough to prevent marking and marring caused by flutter and slap.

Figure 2:
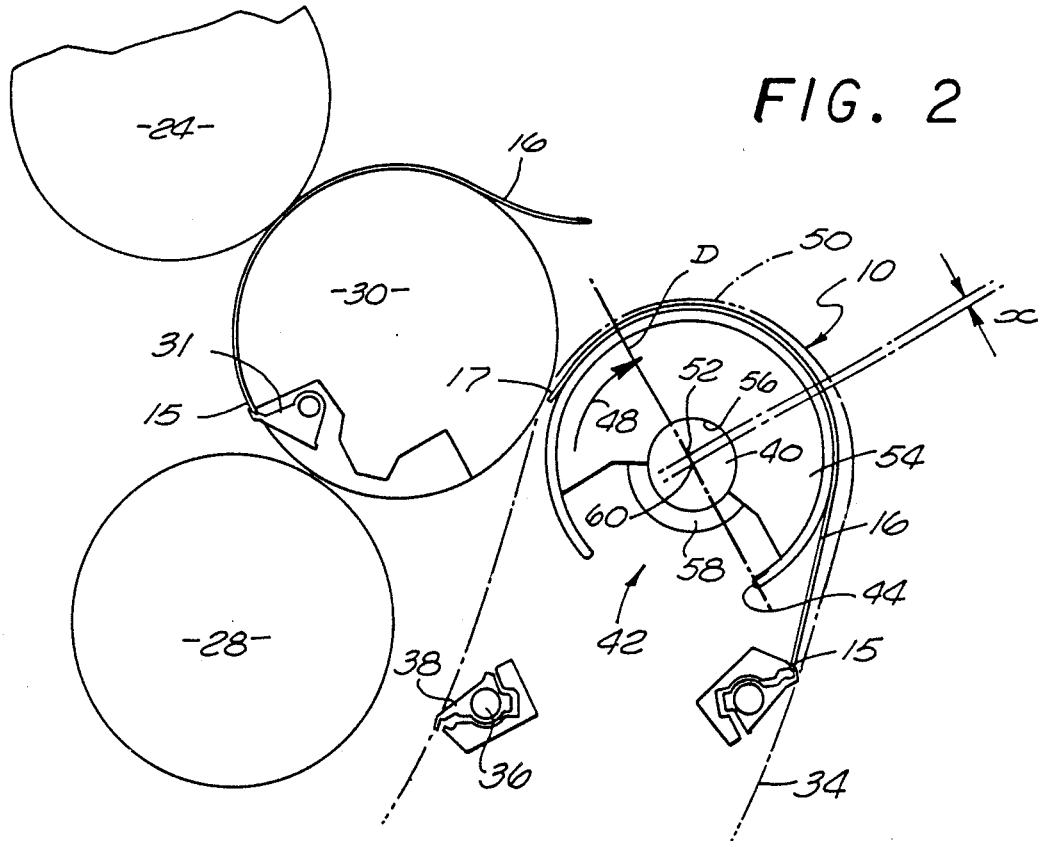
FIG. 2 is an enlarged fragmentary schematic side elevational view of the sheet transfer or delivery cylinder shown in FIG. 1.

As best seen in FIG. 2 of the drawings, the transfer cylinder 10 is formed as a right circular cylinder having an outer cylindrical sheet supporting surface which is a constant radial distance from the cylinder axis of gyration, herein designated by the reference numeral 52. Since the transfer cylinder 10 is formed as a right circular cylinder, the cylinder can be made by any conventional manner from any suitable material such as, for example, an aluminum casting or extrusion, and no special machining or other fabrication techniques are required.

To support the transfer cylinder 10 on the drive shaft 40, a series of webs 54 (only one of which is illustrated) are integrally formed or otherwise secured to the cylinder at longitudinally spaced positions and extend diametrically across the inside surface of the cylinder. Each web 54 herein is provided with a semi-circular recess 56 for receiving the drive shaft 40 which is preferably secured therein by a mating bracket 58 extending around the shaft and bolted or otherwise secured to the web over the semi-circular recess. Each of the webs 54 is positioned circumferentially within the transfer cylinder 10 so that when the drive shaft 40 is mounted in the recesses 56, the axis of rotation of the shaft, herein designated by the reference numeral 60, will lie along a plane extending from approximately the gripper edge 44 of the transfer cylinder diametrically across the cylinder, as herein represented by the center line "D".

The centers of the circles defining the semi-circular recesses 56 are formed in the webs to be off-set from the axis of gyration 52 of the transfer cylinder 10 so that when the transfer cylinder is mounted on the drive shaft 40, the axis of rotation 60 of the drive shaft will be laterally displaced toward the gripper edge 44 of the cylinder along the plane represented by center line "D". With this arrangement, and as can be seen schematically in FIGS. 3 through 5, as the conveyor chain 34 carrying the gripper bars 36 and grippers 38 travels concentrically about the axis of rotation 60 of the drive shaft 40, the transfer cylinder 10 will rotate eccentrically about that axis.

Due to the off-set of the axis of gyration 52 of the transfer cylinder 10 relative to the axis of rotation 60, as each set of grippers 38 engage and pull a sheet 16 from the impression cylinder 30, the leading end 15 of the sheet will follow a path above the gripper edge 44 of the cylindrical support surface of the transfer cylinder, and will not engage that portion of the cylinder. As the grippers 38 continue to pull the sheet 16 from the impression cylinder 30 around the axis of rotation 60, the eccentricity of the transfer cylinder 10 will cause the cylindrical support surface to effectively increase in diameter and rotate smoothly and uniformly into contact with the sheet rearwardly of its leading end 15, and cause the sheet to initially engage the transfer cylinder at a point tangent to the cylindrical support surface.

Figure 3:
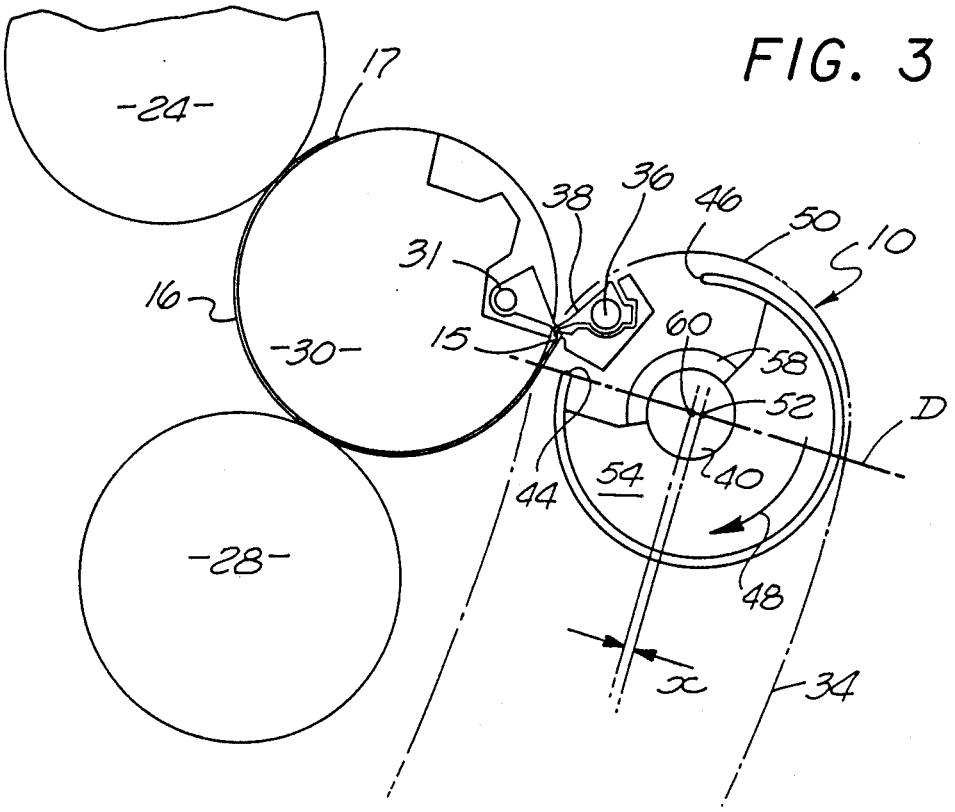
FIG. 3 is a fragmentary schematic view similar to FIG. 2 and showing the rotary position of the transfer or delivery cylinder during initial engagement of the leading or gripper edge of a printed sheet by the sheet grippers.
Figure 4:
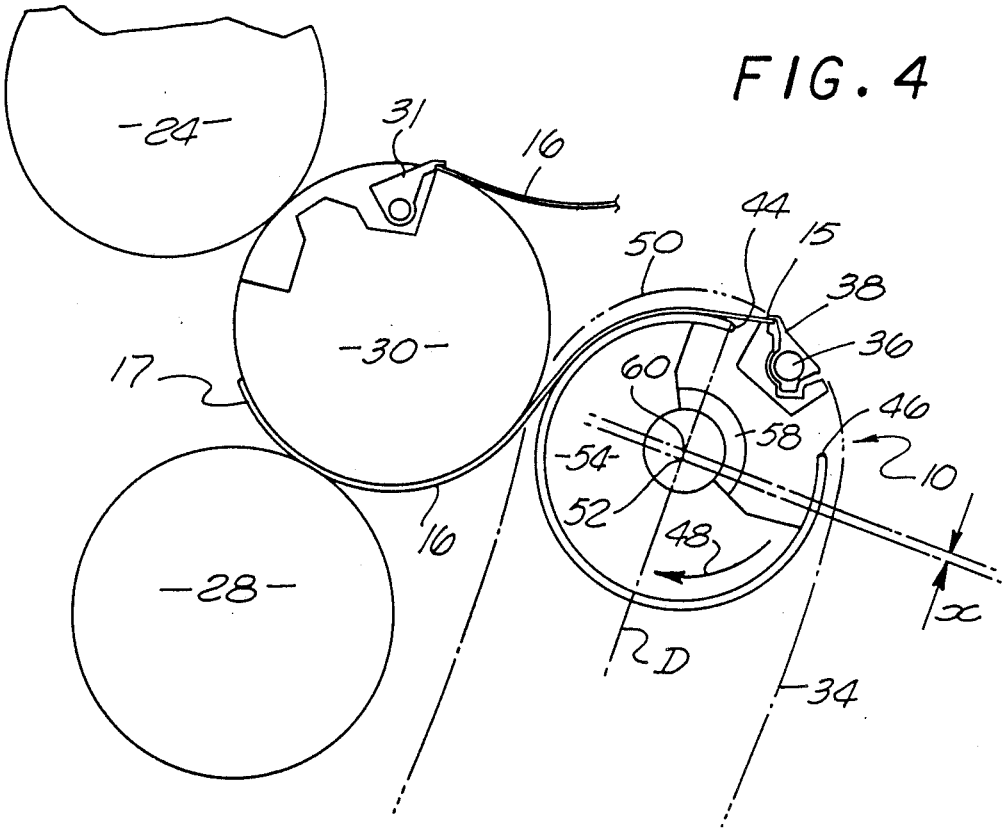
FIG. 4 is a fragmentary schematic view similar to FIG. 3 and showing the transfer or delivery cylinder rotated clockwise approximately ninety degrees from the position shown in FIG. 3.
Figure 5:
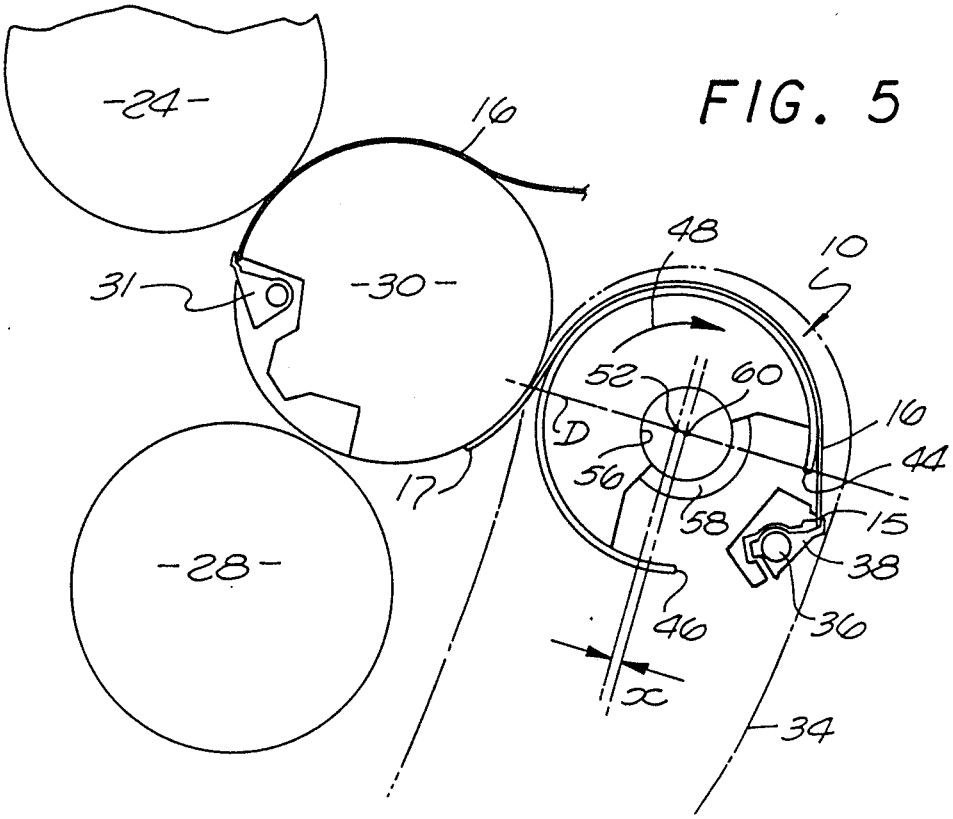
FIG. 5 is a fragmentary schematic view similar to FIG. 3 and showing the transfer or delivery cylinder rotated clockwise approximately 180 degrees from the position shown in FIG. 3.

More specifically, as seen in FIG. 3, when the grippers 38 initially engage the leading end 15 of the sheet 16 adjacent the impression cylinder 30, the gripper edge 44 of the transfer cylinder 10 will lie below the sheet and gripper bar 36 by an amount approximately equal to the off-set, herein indicated in the drawings by "x". As the drive shaft 40 continues to rotate the sprocket wheel 50 and transfer cylinder 10, after approximately forty five degrees of rotation from the point of engagement of the sheet 16 by the grippers 38, the support surface of the transfer cylinder effectively raises toward the sheet to smoothly and uniformly engage the sheet tangentially and rearwardly of its leading end 15, thereby permitting the net loosely covering the support surface to smoothly and evenly engage and attach to the sheet. Thereafter, as shown in FIGS. 4 and 5, with further rotation of the drive shaft 40, the grippers 38 carried by the gripper bar 36 will continue to hold the leading end 15 of the sheet 16 above the gripper edge 44 of the transfer cylinder 10, while the remainder of the sheet will be attached to and supported by the net covering the outer surface of the cylinder from its point of tangential contact rearwardly toward the trailing edge 46 of the cylinder.

It should be noted that as the transfer cylinder 10 continues to rotate eccentrically about the axis of rotation 60, the outer support surface of the transfer cylinder effectively raises toward the sheet 16 to a maximum effective diameter equal to the actual radius of the cylinder plus the off-set amount "x". Thus, as the transfer cylinder 10 rotates toward engagement by the tail end 17 of the sheet 16, the clearance between the impression cylinder 30 and the transfer cylinder reduces, thereby reducing the tendency of the center or tail end portion to flutter or slap upon leaving the nip. It has been found that, depending upon the type of press 12 with which the present invention is to be used and the severity of the bend of the paper path 32 between the impression cylinder 30 and the transfer or delivery cylinder existing in the press, the off-set amount "x" between the axis of gyration 52 of the transfer cylinder 10 and the axis of rotation 60 of the drive shaft 40 should be between approximately 1/16 inch (1.52mm) and approximately ½inch (12.7mm) toward the gripper edge 44, the maximum off-set "x" permitted being determined by the maximum effective diameter of the cylinder required to prevent sheet flutter and slap while permitting the required range of thickness of sheets to be printed. That is, the maximum off-set "x" is determined by adding the off-set amount to the actual radius of the transfer cylinder 10 so that when the effective maximum diameter of the cylinder has been rotated to its closest point adjacent the impression cylinder 30 at the nip, sufficient clearance still exists to permit normal operation of the press 12 consistent with the range of thickness of the sheets 16 to be printed by the press.

In tests conducted on high speed sheet fed off-set presses capable of printing the full range of sheet thicknesses between 0.002 inch (0.05mm) and 0.034 inch (0.86mm), it was found that an offset amount "x" of approximately 0.13 inch (3.30mm) with transfer cylinders 10 having a radius of gyration 52 between 3.0 inch (76.20mm) and 5.13 inch (130.30mm) would produce the desired result. With this offset, it was found that the full range of sheet thickness could be printed without marking or marring the printed sheets on either the leading end 15 or the trailing end 17.

From the foregoing, it can be appreciated that the present invention provides a transfer or delivery cylinder 10 and method of mounting the cylinder within a printing press 12 which is simple in design, yet very effective in preventing marking and marring of a freshly printed sheet 16 in both the areas of the leading and trailing ends. Moreover, the cylinder 10 of this invention can be easily and economically made by conventional means, and is capable of use with substantially any sheet-fed rotary press 12 employing transfer or delivery cylinders. While a particular form of the present invention has been illustrated and described, it should be apparent that variations and modifications therein can be made without departing from the spirit and scope of the invention.

We claim:

1. A method of mounting a right circular transfer cylinder in a sheet fed rotary printing press for use in transferring freshly printed sheets from an impression cylinder to a further processing station within the press, said transfer cylinder having an outer peripheral sheet support surface with a longitudinally extending opening formed therein and defining a leading edge and a cylinder trailing edge, and wherein the press includes a conveyor system comprising conveyor chains drivingly engaged with sprocket wheels and supporting gripper bars carrying grippers for pulling sheets from the impression cylinder onto the transfer cylinder, said transfer cylinder and said conveyor chains being rotatably driven together by a drive shaft extending centrally through said sprocket wheels, the method comprising;

mounting said transfer cylinder eccentrically on said drive shaft such that the leading edge of said transfer cylinder lies below said sheet as said sheet is initially pulled from said impression cylinder by said grippers.

2. The method as set forth in claim 1 wherein said sheet support surface is defined by an axis of gyration of constant radius, and said method of mounting includes mounting said transfer cylinder on said drive shaft with said axis of gyration off-set from the axis of rotation of said drive shaft in the direction of said leading edge.

3. The method as set forth in claim 2 further including mounting said transfer cylinder to said drive shaft with said axis of gyration off-set from said axis of rotation between approximately ⅛ inch and approximately 1/16 inch.

4. In a sheet-fed rotary printing press of the type having a right circular transfer cylinder mounted on a drive shaft which rotates about a fixed axis of rotation for transferring freshly printed sheets from an impression cylinder to a further processing station within the press, the improvement comprising:

means for eccentrically mounting said transfer cylinder to said drive shaft for eccentric rotation about the axis of rotation of said drive shaft.

5. The improvement as set forth in claim 1 wherein said transfer cylinder has an outer peripheral sheet support surface formed by an axis of gyration of constant radius, said outer support surface being discontinuous and defined between a leading edge and a trailing edge, said transfer cylinder being mounted to said drive shaft with said axis of gyration off-set from said axis of rotation in the direction of said leading edge and lying along a diametrical plane passing through each of said axes.

6. The improvement as set forth in claim 5 wherein said axis of gyration is off-set from said axis of rotation by an amount between approximately 1/16 inch and approximately ½inch.

7. A transfer cylinder for a sheet-fed rotary printing press of the type including an impression cylinder for printing a sheet with ink and a pair of laterally spaced conveyor chains carrying gripper bars and grippers for pulling the printed sheet off said impression cylinder and onto said transfer cylinder, said conveyor chain being driven by sprocket wheels of circular cross-section attached to a drive shaft extending laterally across said press adjacent said impression cylinder, said transfer cylinder comprising:

an outer peripheral sheet support surface defined by an axis of gyration having a constant radius;

a longitudinally extending opening formed in said support surface and defining a leading edge and a trailing edge, said gripper bar and grippers being at least partially recessed in said opening during a portion of the movement of said chain about said sprocket wheels;

a fabric cover loosely disposed over said support surface; and mounting means for eccentrically coupling said transfer cylinder to said drive shaft with said axis of gyration off-set from said axis of rotation in the direction of said leading edge, said transfer cylinder being rotated by said drive shaft together with said sprocket wheel, whereby upon initial engagement of said printed sheet by said grippers, said leading edge is disposed below said sheet and as said drive shaft continues to rotate said grippers and said transfer cylinder, said transfer cylinder support surface rises and said sheet is pulled by said grippers tangentially into engagement with said fabric covered support surface.

8. A transfer cylinder as defined in claim 7 wherein said mounting means is off-set from said axis of rotation between approximately 1/16 inch and approximately ½inch.

9. A transfer cylinder as defined in claim 8 wherein said mounting means comprises a web attached to said transfer cylinder and having a semi-circular recess formed therein to receive said drive shaft, said recess being defined by a circle having a center which coincides with said axis of rotation.

10. In a sheet-fed rotary printing press of the type having a transfer cylinder for supporting freshly printed sheets received form an impression cylinder and transferring the sheets to a further processing station within the press, the transfer cylinder having an outer peripheral sheet support surface formed by an axis of gyration of constant radius, said support surface being discontinuous and defined between a leading edge and a trailing edge and mounted on a drive shaft which rotates about a fixed axis of rotation, the improvement comprising:

means for mounting said transfer cylinder to said drive shaft with said axis of gyration offset from said axis of rotation in the direction of said leading edge and lying in a diametrical plane passing through each of said axes, whereby said leading edge lies below the sheets as said sheets are initially received from said impression cylinder and said support surface rises to tangentially engage said sheets rearwardly of said leading edge as said support surface is rotated by said drive shaft eccentrically about said axis of rotation.

11. A transfer cylinder for transferring freshly printed sheets from an impression cylinder to a further processing station within a sheet-fed rotary printing press, said transfer cylinder being mounted on a drive shaft having a fixed axis of rotation, said transfer cylinder comprising:

a right circular cylinder having on outer peripheral sheet support surface formed by an axis of gyration of constant radius, said sheet support surface being discontinuous and defined between a leading edge and a trailing edge; and mounting means for mounting said transfer cylinder to said drive shaft with said axis of gyration offset from said axis of rotation in the direction of said leading edge with said axis of gyration lying along a plane extending diametrically through said axis of rotation, said mounting means comprising a web attached to said transfer cylinder and having a semi-circular recess formed therein for receiving said drive shaft, the center of the circle defining said recess lying within said plane.

12. A transfer cylinder as defined in claim 11 wherein said mounting means is off-set by an amount between approximately 1/16 inch and approximately ½inch.

* * * * *

UNITED STATES PATENT AND TRADEMARK OFFICE

CERTIFICATE OF CORRECTION

PATENT NO. : 4,967,656

DATED : November 6, 1990

INVENTOR(S) : David D. Douglas and James A. Elliott

It is certified that error appears in the above-identified patent and that said Letters Patent is hereby corrected as shown below:

In Column 9, line 19, delete "1/8" and insert therefor --1/2--.

In Column 9, line 30, delete "1" and insert therefor --4--.

In Column 10, line 23, delete the word "form" and insert therefor --from--.

Signed and Sealed this

Thirty-first Day of March, 1992

*Attest:*

HARRY F. MANBECK, JR.

*Attesting Officer*

*Commissioner of Patents and Trademarks*